US010906089B2

(12) United States Patent
Osmont et al.

(10) Patent No.: US 10,906,089 B2
(45) Date of Patent: Feb. 2, 2021

(54) MANUFACTURE OF PARTS USING THE LOST WAX METHOD

(71) Applicant: SAFRAN AIRCRAFT ENGINES, Paris (FR)

(72) Inventors: Hervé Bruno Marc Osmont, Moissy-Cramayel (FR); Pascal Francis Patrick Gomez, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/720,280

(22) Filed: Dec. 19, 2019

(65) Prior Publication Data

US 2020/0198001 A1 Jun. 25, 2020

(30) Foreign Application Priority Data

Dec. 19, 2018 (FR) ..... 18 73329

(51) Int. Cl.

| | |
|---|---|
| ***B22C 7/02*** | (2006.01) |
| ***B28B 1/26*** | (2006.01) |
| ***B28B 3/00*** | (2006.01) |
| ***B28B 7/34*** | (2006.01) |

(52) U.S. Cl.

CPC ..... *B22C 7/02* (2013.01); *B28B 1/262* (2013.01); *B28B 1/265* (2013.01); *B28B 3/003* (2013.01); *B28B 7/342* (2013.01)

(58) Field of Classification Search

CPC .. B22C 7/00; B22C 7/005; B22C 7/02; B22C 9/00; B22C 9/02

See application file for complete search history.

(56) References Cited

FOREIGN PATENT DOCUMENTS

| | | |
|---|---|---|
| EP | 0730922 A1 | 9/1996 |
| FR | 2874340 A1 | 2/2006 |

OTHER PUBLICATIONS

French Application No. 1873329; Search Report dated Sep. 16, 2019—8 pgs. (In French; relevance found in the citations therein).

*Primary Examiner* — Kevin P Kerns
*Assistant Examiner* — Steven S Ha
(74) *Attorney, Agent, or Firm* — Lathrop GPM LLP

(57) ABSTRACT

The invention relates to the making, on a support plate (34), of an annular space (76) in a ceramic paste covering this plate, in order, by successive deposits and firing of layers of said ceramic paste, to create a base of a ceramic shell (40) for the moulding of parts, the base having said annular space (76). For this purpose, between two deposits of said ceramic paste, and on the plate, said deformable annular element (82) will be deformed in order to break the ceramic layer.

19 Claims, 2 Drawing Sheets

MANUFACTURE OF PARTS USING THE LOST WAX METHOD

CROSS-REFERENCE TO RELATED APPLICATION

This application claims priority to French Patent Application No. 1873329, filed Dec. 19, 2018, which is incorporated herein by reference.

TECHNICAL FIELD OF THE INVENTION

The present invention relates to the manufacture of parts using the lost wax method.

Directional, columnar or monocrystalline solidification (s), is(are) concerned, in particular for the manufacture of turbojet engine blades.

This targets a lost-wax casting method.

Also covered are assemblies for moulding parts:

one comprising a cluster and a cluster support plate, the other including a ceramic moulding shell and the same plate.

It also includes turbojet blades obtained using the method in question, as well as an aircraft turbomachine equipped with such blades.

PRIOR ART

Below is a detailed description of the manufacture of metal parts, generally made of metal alloys, with complex shapes, using a lost-wax foundry, also known as a lost-model foundry.

The main steps of a lost-wax method include:

the making of wax models, gathered in clusters around a central barrel also made of wax, the constitution of a shell, comprising successive operations of coating slip and sprinkling refractory sand (ceramic paste below) around the wax models thus coated, the elimination of wax models, the casting of the molten metal into the previously formed shell, the cooling and solidification of the cast metal, a stripping step, which consists of removing the shell, a final step of cutting and finishing the obtained moulded parts.

Cooling and solidification preferably involve directional solidification, when it is desirable to give the castings particular mechanical and physical properties. This is particularly the case for turbojet blades.

The directional solidification consists in controlling successively the germination and growth of solid material crystals, in order to minimize the harmful effects of grain joints in cooled castings. The directional solidification can be columnar or monocrystalline. The columnar directional solidification consists of directing all grain joints in the same direction, so that they do not contribute to the propagation of cracks. The monocrystalline directional solidification consists in completely eliminating grain joints.

The directional, columnar or monocrystalline solidification(s), is(are) obtained by placing a shell mould, open at its lower part, on a cooled plate, by introducing the assembly into a heating equipment that maintains the ceramic mould at the temperature of the liquidus of the alloy. Once the casting is completed, the metal located in openings provided at the bottom of the shell mould solidifies in contact with the cooled plate, and naturally settles to a height of the order of one centimetre on which it has an equiaxic granular structure, with no preferred direction. Beyond that, the metal remains in a liquid state. A mechanical device allows the plate to be moved at a controlled speed downwards, thus slowly extracting the ceramic mould from the heating device leading to a progressive cooling of the metal which continues to solidify from the lower part of the mould to the upper part.

With the columnar directional solidification, the columnar structure consists of a set of narrow and elongated grains.

In the single crystal directional solidification, either a baffle or a grain selector or a single crystal seed is placed between the part to be moulded and the cooled plate, so that the creation of new germs in front of the solidification front is impossible when controlling the thermal gradient and solidification rate. The result is a monocrystalline moulded part after cooling.

From FR2874340, an assembly for moulding parts is also known, the assembly including:

a) a wax cluster comprising:

a plurality of models of the parts to be moulded, a central barrel around which the models are placed, a plurality of segments that connect the models to the central barrel, grain selection areas under the models, and (b) a support plate for supporting the wax cluster.

This also includes a set of:

a) a ceramic moulding shell for moulding parts made in a material, the ceramic moulding shell comprising:

which communicate together:

an upper (material inlet) neck, for entering the material in the ceramic moulding shell a first central tube, erected and located under the upper neck, a plurality of peripheral moulding cavities of the parts (forming second hollow tubes) having (substantially) in hollow the shape of the parts to be moulded, the moulding cavities being arranged around the first central tube and connected to both the first central tube and the upper neck by material circulation channels, as well as to lower material flow parts, and a bottom extending between a base of said first central tube and said lower material flow parts, the bottom having an annular space, (b) a support plate for supporting the moulding shell.

Thus, on such a ceramic shell moulding assembly, the upper neck, first central tube and moulding cavities communicate with each other. And, it is from the bottom that the cluster is placed in a so-called solidification furnace.

During the solidification phase when casting an alloy in a ceramic cluster made from lost wax for the manufacture of parts, in particular monocrystalline parts, the shrinkage is exerted on the parts containing the alloy and not on the central part (above: the central barrel/first central tube). This results in different mechanical pulls and leads in order of gravity to:

deformations on the models (non-quality), grains recrystallized on the models (non-quality), model ruptures and breaks (scrap), leaks during casting (impact on production: shutdown of equipment for cleaning).

This can be accentuated in the case of "3-storey" clusters (see below) or clusters whose height (direction of elevation) is higher than the overall section.

In fact, the difficulties encountered in defining a relevant solution to these problems have included:

understanding the rupture/deformation mechanism of the cluster during the solidification, keeping the geometry of the clustering, limiting the impact on cycle time in production.

It was sought to ensure control of mechanical stresses towards the centre of the cluster decoupled from the rest of the cluster (model and feed parts), by separating the two, the difference in shrinkage between the centre of the cluster and the rest of the cluster then no longer having an impact on the models.

Certainly, a moulding shell base (typically made of ceramic) with an annular space is known, as mentioned above. But, the efficient way to achieve it and maintain this annular space can be improved.

SUMMARY OF THE INVENTION

It is therefore first proposed that the first aforementioned wax cluster assembly for casting parts should be such that it also includes a deformable annular element arranged on the aforementioned support plate between said central barrel and the grain selection areas.

Thus, the desired annular space will be created there, at the place of a coating of ceramic paste covering the wax cluster.

The deformable annular element will be located opposite the moulding part models.

The annular space will be created when the moulding shell is made.

As can be understood, the coating of the ceramic paste covering the wax cluster on said assembly for casting parts will form this casting shell.

For all purposes, it is confirmed that the expression "deformable annular element" implies that said element is centrally open and has a perimeter that can be closed. This element is also flexible, in the sense that it can be deformed somewhat without being destroyed. In particular, said element can therefore support the coating of a ceramic paste, barely subsiding, in other words by slightly adapting its shape to the stresses of this coating. It is therefore understandable that an annular inflatable element (hereinafter a bladder or inflatable bladder) may be appropriate.

It is also proposed that the other ceramic moulding shell assembly also should include such a deformable annular element arranged at the location of said annular space, with the same advantages.

In particular, it may be expected that this annular space will extend over a closed perimeter.

A totally peripheral limitation will then be ensured, possibly with a single piece.

Ensuring the deformability of said annular element by means of an inflatable bladder will make it possible to act only when desired, to free up the space the rest of the time (by deflating the bladder) and to maintain the integrity of the shell during the blowing phases in the bladder (limited risk of cracks or even cluster breaks).

Maintaining the deformable annular element in a stable position may be useful to avoid interfering with the surrounding ceramic paste parts. It is therefore proposed that this annular element should have end caps that pass through the plate in order to fix it thereto, in the same way as a rubber element inserted into a hole.

To also free up the space on the side of the support plate where the annular space is located, it is recommended that the bladder to inflate should be connected to a inflating fluid source for feeding the deformable annular element with the inflating fluid through the support plate.

If we are now interested in the method of making, on the support plate, said annular space in a ceramic paste covering the plate, in order to create, by successive deposits and firing of layers of said paste, a ceramic shell base thus opened, we will understand that it is proposed:

a) to place this deformable annular element on the plate, b) then to deform it between two deposits of said ceramic paste, in order to break the ceramic layer created or being created.

With the same characteristics a) and b) above, it is also proposed a method for making a so-called ceramic moulding shell assembly in which the moulding shell is formed by successive deposits and firing of ceramic paste layers.

In view of the above, it may also be preferable:

to use, as a deformable annular element, an inflatable bladder which will therefore be inflated between two deposits of said ceramic paste, or even inflate the bladder after firing each deposit of said ceramic paste.

The invention will be better understood and other details, characteristics and advantages of the invention will appear when reading the following description, which is given as a non-limiting example, with reference to the attached drawings.

DETAILED DESCRIPTION OF THE INVENTION

The examples shown in the figures are representative of the manufacture of turbojet blades. They relate to a single crystal directional solidification, but could relate to a columnar directional solidification without changing the essential characteristics of the invention.

Figure 1:
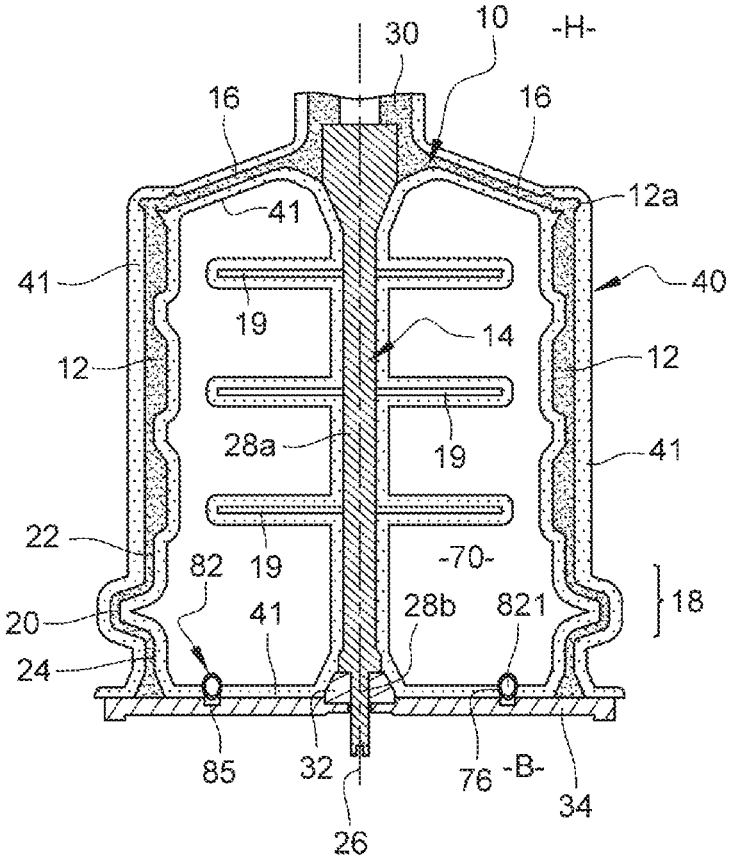
FIG. 1 is a vertical section of the essential part of a wax cluster covered with a ceramic envelope which, stacked layer after stacked layer, must correspond to the shell of FIG. 3.

FIG. 1 shows, partially and in vertical section, a wax cluster 10 covered with a ceramic shell which will correspond below to the shell 40.

The cluster 10 consists, in a single piece:

of models 12 of the parts to be manufactured, made of wax, of a central barrel (also called a descending barrel) 14, also made of wax, around which the models 12 are placed, of segments 16, also in wax, which connect models 12 to the central barrel 14, of grain selection areas 18, also made of wax, respectively arranged under the models 12, these grain selection areas 18 having a substantially U-shaped intermediate part 20 (substantially crankshaft-shaped), a lower part 22 with an enlarged cross-section serving as a base, and an upper part 24 also having a substantially cone-shaped enlarged cross-section whose tip is at the bottom (marked B), the axis 26 cluster 10 being considered vertical, possibly of one or more additional internal support(s) 19, also made of wax, respectively arranged in circumferential projection around the central barrel 14.

The intermediate part 20 has a substantially crankshaft shape because the example shown is that of a directional monocrystalline solidification. The intermediate part 20 is used to create a baffle, as described below.

Each model 12 can have one or more insert(s) or core(s), preferably made of ceramic, if it is desired to obtain one or more hollow part(s) inside.

In the selected embodiment, the segments 16, which serve as a link between the central barrel 14 and the peripheral and concentric models 12, here erected parallel to axis 26, therefore vertically, are located in the upper part (top marked B) of the cluster 10.

Staggered along the central barrel 14, the internal additional supports 19 can be made of graphite paper. They are individually presented as a solid annular disc.

The central barrel 14 is defined by a solid rod 28*a* which passes axially through an upper central block 30 of the cluster 10 from which the segments 16 extend radially in a star pattern down to the bottom, where the rod 28*a* is extended by a screw 28*b* screwed with a nut 32, both supported on a plate 34 which can be made of aluminium. The nut is locked in rotation in the plate.

The plate 34 is a support, like a plate, for the cluster 10, which rests and stands on this plate. In this case, the plate 34 is a flat and solid plate that extends all around the axis 26, under the whole cluster; see FIGS. 1 and 2.

The plate 34 is evacuated when the wax is removed. It is then through its ceramic bottom 78 (see FIG. 3 and details below) that the cluster 10, placed in a so-called solidification furnace to achieve the expected solidification, will come into direct contact with the bottom of the furnace, this bottom 78 ensuring tightness.

Figure 3:
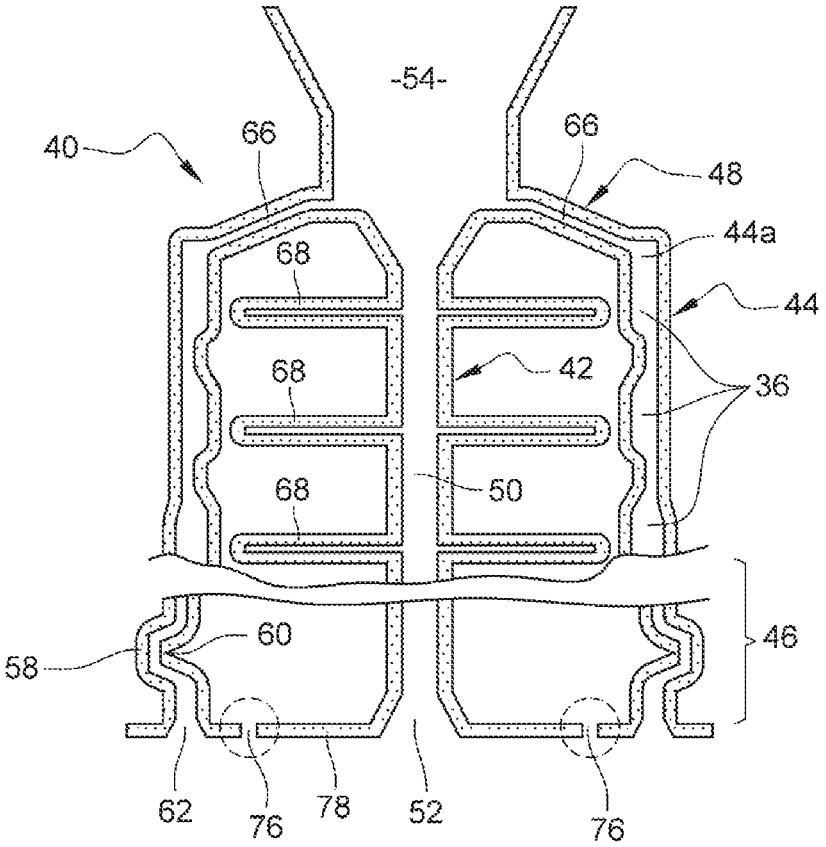
FIG. 3 is, seen as FIG. 1, the ceramic shell from the wax cluster in FIG. 1.

Before that, the wax cluster 10 will have been coated with slip and then covered with refractory sand, repeating these two actions a number of times until a satisfactory thickness of ceramic material constituting a shell is obtained, such as the one marked 40 in FIG. 3.

The shell 40, obtained after this first operation, is an intermediate shell, which includes a first part of a shell 42, second parts of a shell 44, third parts of a shell 46, and fourth parts of a shell 48.

The first part of a shell 42 corresponds to the central wax barrel 14. It is essentially in the form of a hollow erect, here vertical, tube 50, delimiting an elongated cavity. It ends at the lower end with a lower flared part delimiting a lower extended area 52 of the cavity 50. It ends at the upper end with an upper flared part delimiting an upper widened area of the cavity 50 forming a material inlet upper neck 54.

The second shell parts 44 correspond to the wax models 12 and are in the form of hollow moulds delimiting the moulding cavities of the parts, thus having substantially the hollow shape of the parts to be manufactured. They are distributed around the first part of a shell 42.

The third part 46 of the shell corresponds to the wax grain selection areas 18. They each have an intermediate part 58, which is substantially in the form of hollow and double-angled vertical tubes delimiting a cavity 60 in the shape of a baffle, a flared lower part delimiting an enlarged lower zone 62 of the cavity 60. The third parts of a shell 46 constitute selector assemblies and grain ducts.

The fourth parts 48 of the shell correspond to the wax segments 16. They are in the form of channels 66 connected at each end to the highest part 44*a* of each second shell part 44 and the first shell part 42 respectively. They are inclined so that their end connected to the first shell part 42 is higher than their end connected to the top of the second shell part 44.

The cavities 56 (also called second peripheral hollow tubes) distributed around the cavity 50 (also called first central tube) are therefore connected to the cavity 50 and the upper neck 54 by the material flow channels 66, as well as to said third shell parts 46 which therefore form lower material flow parts up to the plate 34. The first central tube 50 is plugged by the solid rod 28*a*; thus, the metal cannot flow into it.

Such an intermediate shell 40 is made around the wax cluster 10 including the central barrel 14, models 12, grain selection areas 18 and segments 16.

Therefore, the first, second, third and fourth shell parts 42, 44, 46, 46, 48 are in communication with each other and delimit a global cavity combining the cavities and/or parts of cavities 50, 52, 54, 56, 60, 62, 66.

If additional internal supports 19 exist, the shell 40 has additional parts of shell 68 similar to shells of a substantially annular shape. Individually their section has a significant U shape. They are made of the same material as the rest of the shell.

The additional shell parts 68, all located inside the internal recess 70 peripherally delimited by the models 12 extended by the grain selection areas 18 and, at the top, by the segments 16, act on the thermal parameters of the solidification.

The additional parts of the shell 40 can:

act as obstacles to thermal radiation, limit the cooling of the shell 10, facing the internal recess 70, behave like thermal lenses, allow to locally control and modify the shape of the solidification front, and therefore to avoid porosity defects at the end of the solidification.

Once such a shell 40 has been made on the plate 34, they are both placed in a solidification furnace. It can be an induction furnace with hot and cold zones separated from each other by an insulating screen, the walls of the hot zone being equipped with devices capable of generating thermal radiation towards this hot zone.

The plate 34 is able to move in a direction parallel to the vertical axis 26, inside the cold zone of the solidification furnace.

Resting on the plate 34, the ceramic shell 40 will then receive molten metal during the so-called casting stage.

However, during the solidification phase when casting the alloy concerned into the shell 40 for the manufacture of parts (in particular monocrystalline parts), a shrinkage occurs on the parts containing the alloy and not (less) on the central part (the first part of the shell 42). This results in different mechanical pulls and leads to:

deformations on the models (quality defect), grains recrystallized on the models (quality defect), model ruptures and breaks (scrap), leaks during casting (impact on production; shutdown of equipment for cleaning).

This is even accentuated in the case of multi-storey clusters ("3 stages" in the case in point) and/or when the cavities 56 having substantially the hollow shape of the parts to be manufactured are very long, especially since it is necessary, after solidification of the alloy, to uncheck the shell 40 with a hammer in order to release the metal parts, here stepped together in a cluster, at the place of the cavities 56.

In fact, there is often a mechanical stress problem between the centre of the cluster (down 14) and the rest of the cluster (model part 12 and power supply; channels 16). Dissociating the two at the location of a space 76, as shown in FIG. 3

(circled area), is one solution. An annular space at the bottom 78 that extends between the base of the central cavity 50 and that of each enlarged low zone 62 of the shell 40 is suitable. The difference in shrinkage between the center of the cluster (down 14) and the rest of the cluster, and thus the impact on the models, can then be controlled.

However, there is still a problem concerning the way in which the space 76 is to be created, with a dual purpose:

- ensure the ability to produce clusters of parts of high heights, while integrating into conventional production processes,
- limit the mechanical forces on the shell 40 that can generate non-quality (scrap, etc . . . ).

The simple and efficient solution of the invention is to use a deformable annular element placed on the plate 34, between the central barrel 14 and the grain selection areas 18, so that the annular space 76 is created there, at a place (location) therefore of the coating of ceramic paste whose cluster 10 will have been covered with wax. The paste coating is formed by a series of layers of ceramic paste.

Thus, once coated, the ceramic paste will cover the wax cluster 10, except at the location of the annular space 76.

The term "annular" covers the case of a ring extending by sectors (element then in several parts, which can communicate with each other if necessary) or an open ring, it is specified that, in at least a number of cases, the deformable annular element will still extend over a closed perimeter (see FIG. 2), as long as the annular space itself extends over a closed perimeter. It will therefore be a totally closed ring, which can favour thermal and mechanical stress control in the cluster 10 and the shell 40, and therefore in the final moulded parts.

Defining the annular element 82 as an inflatable bladder 821 (or inner tube) will allow the deformation(s) of this annular element 82 to be carried out in a relevant manner, at a distance and at will.

For its maintenance, whatever its condition, the deformable annular element 82 can be provided with end pieces 84 which cross the plate 34, to open at the opposite side of the face where the cluster 10 or the shell 40 stands. This avoids interfering with the bottom realization area 78.

An annular notch 85 on the upper side of the plate 34 (FIG. 1) may also be used to stabilize the position of the element 82.

Figure 2:
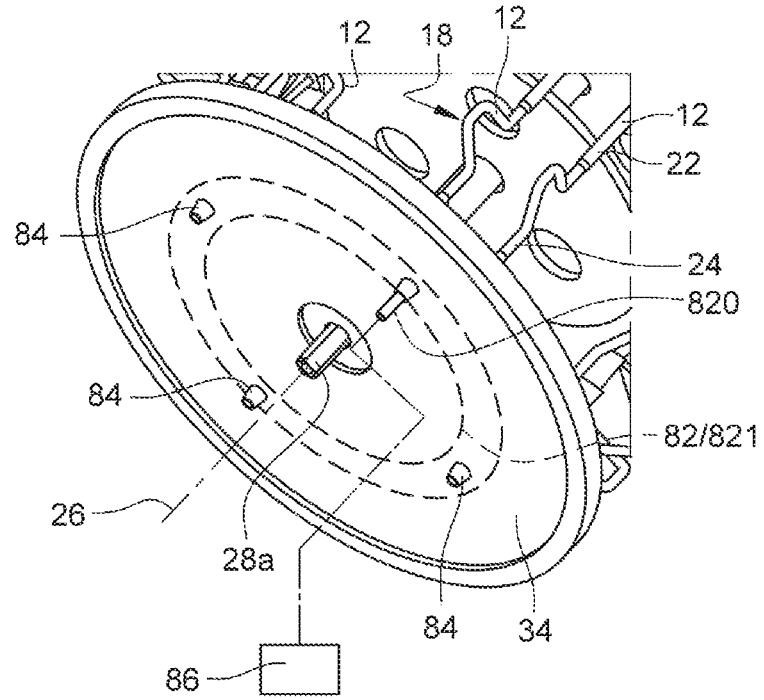
FIG. 2 is a local view in perspective of the bottom (lower) part of the wax cluster of FIG. 1.

For similar considerations, it is proposed that the inflatable bladder 82 should be connected, through the plate 34 and through a connection 820, to a source of inflation fluid 86; see FIG. 2.

Concerning the way to create space 76, it is recommended:

- first, to place said deformable annular element 82 on the support plate 34,
- then to cover the plate 34 with ceramic paste, by successive deposits of layers 41 (FIG. 1), in order to prepare the creation of said base 78, the ceramic paste being, at this time, deposited around the different parts 12,14, 16,18,19 of the cluster 10, so that these parts are also covered with paste,
- at each layer deposit, to fire the layer of ceramic paste deposited,
- and, between two deposits of said ceramic paste, deforming said annular element 82 to break the ceramic layer.

Thus, once the space 76 materialized by the annular element 82 placed on the plate 34, this space 76 can be maintained at each successive deposit and firing, since the ceramic layer formed around the element 82 is broken.

In particular, to avoid as much as possible interfering with the ceramic areas forming around the element 82 and for efficiency, it is proposed that, if an inflatable bladder 821 is used, it should be inflated between two deposits of said ceramic paste.

The surrounding mechanical stresses will then be very limited and the presence of the space 76 will ensure that the shell itself has mechanical stability free of such mechanical stresses.

To further increase the effectiveness of the solution, it is recommended to inflate the bladder 821 after firing each deposit of said ceramic paste.

In this way, during the moulding process and between two successive layers of dried ceramic, the bladder 821 will be blown into to break the deposited ceramic layer. Repeating the operation after each layer, after moulding and before waxing, will allow clean breaks to be made on a limited thickness of material.

At the end of the moulding operation, and in the lower part, the central part 42 and the centre of the bottom 78 of the shell will be separated from the rest of the cluster (shell parts 46 and 44).

After the wax removal operation, the element 82 is evacuated with the plate.

A shell cut between the descendant 14 (and therefore the central part 42) and the model part (second shell parts 44) is thus obtained.

The invention claimed is:

1. An assembly for moulding parts, the assembly comprising:

a) a wax cluster comprising:
- models of the parts,
- a central barrel around which the models are arranged,
- segments that connect the models to the central barrel,
- a plurality of grain selection areas arranged respectively under the models, and b) a support plate for supporting the wax cluster, wherein said assembly further comprises a deformable annular element disposed on the support plate, between the central barrel and the grain selection areas, for creating an annular space at a location of a ceramic paste coating covering the deformable annular element.

2. An assembly according to claim 1, which comprises said ceramic paste coating which covers the wax cluster.

3. An assembly according to claim 2, wherein the annular space extends on a closed perimeter.

4. An assembly according to claim 2, wherein the deformable annular element has end pieces that pass through the support plate.

5. An assembly according to claim 1, wherein the annular space extends on a closed perimeter.

6. An assembly according to claim 5, wherein the deformable annular element is defined by an inflatable bladder.

7. An assembly according to claim 1, wherein the deformable annular element is defined by an inflatable bladder.

8. An assembly according to claim 7, wherein the deformable annular element has end pieces that pass through the support plate.

9. An assembly according to claim 8 wherein the inflatable bladder is connected to an inflating fluid source for feeding the deformable annular element with the inflating fluid through the support plate.

10. An assembly according to claim 7 wherein the inflatable bladder is connected to an inflating fluid source for feeding the deformable annular element with the inflating fluid through the support plate.

11. An assembly according to claim 1, wherein the deformable annular element has end pieces that pass through the support plate.

12. A method for making, on the support plate of the assembly according to claim 1, said annular space in the ceramic paste covering said support plate, in order to, by successive deposits and firing of layers of said ceramic paste, to create a base of a ceramic shell for the moulding parts, the base having said annular space, wherein said deformable annular element is arranged on the support plate and deformed between two deposits of said ceramic paste in order to break the deposited ceramic layer.

13. A method according to claim 12, wherein said deformable annular element is an inflatable bladder inflated between two deposits of said ceramic paste.

14. A method according to claim 13, in which the bladder is inflated after firing each deposit of said ceramic paste.

15. An assembly comprising:

a) a ceramic moulding shell for moulding parts made in a material, the ceramic moulding shell comprising:

an upper neck, for entering the material in the ceramic moulding shell, a first central tube, erected and located under the upper neck, a plurality of peripheral moulding cavities having in hollow the shape of the parts to be moulded, the peripheral moulding cavities being arranged around the first central tube and connected to the first central tube and the upper neck by material circulation channels, as well as to lower material flow portions, the upper neck, the first central tube and the moulding cavities communicating together, and a bottom extending between a base of said first central tube and said lower material flow portions, the bottom having an annular space, b) a support plate for supporting the moulding shell, wherein said assembly further comprises a deformable annular element provided at the location of said annular space.

16. An assembly according to claim 15, wherein the annular space extends on a closed perimeter.

17. An assembly according to claim 15, wherein the deformable annular element is defined by an inflatable bladder.

18. A method for making a moulding assembly according to claim 15, wherein the moulding shell is formed by successively depositing and firing layers of ceramic paste, and wherein said deformable annular element is arranged on the support plate and deformed between two deposits of said ceramic paste in order to break the deposited ceramic layer.

19. A method according to claim 18, wherein said deformable annular element is an inflatable bladder inflated between two deposits of said ceramic paste.

* * * * *